US011111920B2

(12) United States Patent
Lee et al.

(10) Patent No.: US 11,111,920 B2
(45) Date of Patent: Sep. 7, 2021

(54) SUCTION VALVE ASSEMBLY FOR A COMPRESSOR AND A COMPRESSOR HAVING A SUCTION VALVE ASSEMBLY

(71) Applicant: LG ELECTRONICS INC., Seoul (KR)

(72) Inventors: Donggeun Lee, Seoul (KR); Kyojin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 143 days.

(21) Appl. No.: 16/659,884

(22) Filed: Oct. 22, 2019

(65) Prior Publication Data

US 2020/0408207 A1 Dec. 31, 2020

(30) Foreign Application Priority Data

Jun. 25, 2019 (KR) ..... 10-2019-0075504

(51) Int. Cl.
*F04C 18/02* (2006.01)
*F04C 29/12* (2006.01)

(52) U.S. Cl.
CPC ..... *F04C 18/0215* (2013.01); *F04C 29/12* (2013.01); *F04C 29/124* (2013.01)

(58) Field of Classification Search
CPC ..... F04C 29/12; F04C 29/124; F04C 29/126; F04C 18/0215
See application file for complete search history.

(56) References Cited

U.S. PATENT DOCUMENTS 4,545,747 A * 10/1985 Tamura ..... F04C 18/0215 418/55.1
4,958,993 A * 9/1990 Fujio ..... F04C 27/005 418/55.3
5,395,214 A * 3/1995 Kawahara ..... F04C 18/0215 417/53
7,331,774 B2 * 2/2008 Ueda ..... F04C 27/005 418/104

(Continued)

FOREIGN PATENT DOCUMENTS

CH 164448 9/1933
EP 1199476 A2 * 4/2002 ..... F04C 29/065

(Continued)

OTHER PUBLICATIONS

European Search Report dated Jan. 15, 2020.
Korean Office Action dated Sep. 17, 2020
Korean Office Action dated Jan. 20, 2021.

*Primary Examiner* — Mark A Laurenzi
*Assistant Examiner* — Xiaoting Hu
(74) *Attorney, Agent, or Firm* — Ked & Associates LLP

(57) ABSTRACT

A suction valve assembly for a compressor and a compressor having a suction valve assembly. The suction valve assembly may include a body that connects a compression chamber of the compressor with an accumulator, and a lifting/lowering valve provided in the body. The lifting/lowering valve may be moved upward by a pressure difference between an inner space of the accumulator and an inner space of the compression chamber when operation of the compressor stops and block reverse flow of oil to the accumulator. Accordingly, when operation of the compressor stops, compressed oil may be prevented from reversely flowing to the accumulator.

19 Claims, 17 Drawing Sheets

(56) References Cited

U.S. PATENT DOCUMENTS

| | | | | |
|---|---|---|---|---|
| 9,482,229 | B2 * | 11/2016 | Adaniya | F04C 28/28 |
| 2005/0100469 | A1 * | 5/2005 | Matsunaga | F04C 29/12<br>418/55.1 |
| 2018/0202440 | A1 * | 7/2018 | Lee | F04C 18/0261 |

FOREIGN PATENT DOCUMENTS

| | | | |
|---|---|---|---|
| EP | 1 655 492 | | 5/2006 |
| JP | 1989-177481 | | 7/1989 |
| JP | 05-024990 | | 4/1993 |
| JP | H0524990 | U * | 4/1993 |
| JP | 2015-078608 | | 4/2015 |
| JP | 2015078608 | A * | 4/2015 |
| KR | 10-0575700 | | 5/2006 |
| KR | 10-2010-0025185 | | 3/2010 |
| KR | 10-2016-0020190 | | 2/2016 |
| KR | 10-2018-0083646 | | 7/2018 |
| KR | 10-2018-0086749 | | 8/2018 |
| KR | 10-2018-0093693 | | 8/2018 |
| KR | 20180093693 | A * | 8/2018 |
| WO | WO 2006/073048 | | 7/2006 |

* cited by examiner

SUCTION VALVE ASSEMBLY FOR A COMPRESSOR AND A COMPRESSOR HAVING A SUCTION VALVE ASSEMBLY

CROSS-REFERENCE TO RELATED APPLICATION(S)

The present application claims priority to Korean Patent Application No. 10-2019-0075504, filed in Korea on Jun. 25, 2019, the entire contents of which is incorporated herein for all purposes by this reference.

BACKGROUND

1. Field

A suction valve assembly for a compressor and a compressor having a suction valve assembly are disclosed herein.

2. Background

Generally, a compressor is a mechanical device used for producing high pressure or transferring a high-pressure fluid. The compressor may be applied to a refrigeration cycle of a refrigerator or an air conditioner, for example, and compresses a refrigerant and transfers the compressed refrigerant to a condenser. Compressors are typically classified into a reciprocating compressor, a rotary compressor, or a scroll compressor according to a method of compressing a gas refrigerant.

The scroll compressor includes a fixed scroll fixed in an inner space of a sealed container and an orbiting scroll engaged with the fixed scroll to perform an orbiting movement, whereby suction, gradual compression, and discharge of a refrigerant are continuously and repetitively performed by a compression chamber continuously defined between a fixed wrap of the fixed scroll and an orbiting wrap of the orbiting scroll. A discharge hole is provided in the fixed scroll of the scroll compressor so as to discharge the compressed refrigerant, and a discharge valve is provided in the discharge hole. Accordingly, the refrigerant compressed in the compression chamber may be discharged to a discharge chamber, and when operation of the compressor stops, the discharge hole may be closed to prevent the refrigerant from reversely flowing through the discharge hole and the orbiting scroll from reversely rotating. Such a scroll compressor is disclosed in Korean Patent Application Publication No. 10-2016-0020190, which is hereby incorporated by reference.

However, the structure for preventing reverse flow of refrigerant using the discharge valve, which is described above, prevents the reverse flow of the refrigerant existing only in the discharge chamber. However, when operation of the compressor stops, the structure may not prevent refrigerant and oil existing in the compression chamber defined between the fixed scroll and the orbiting scroll from reversely flowing through a refrigerant suction pipe to an accumulator. In addition, product reliability is decreased due to contact noise occurring during operation of the compressor.

Recently, to prevent refrigerant and oil from reversely flowing through the refrigerant suction pipe, as described above, to the accumulator, there have been developed various reverse flow prevention valves on a refrigerant discharge side of the refrigerant suction pipe (or a refrigerant inflow side of the compression chamber), in an inner space of the refrigerant suction pipe, or in the accumulator. Various reverse flow prevention valves are disclosed in Korean Patent No. 10-0575700, Korean Patent Application Publication No. 10-2018-0083646, and Korean Patent Application Publication No. 10-2018-0086749, which are all hereby incorporated by reference.

However, in the compressor having a structure employing each of the related art reverse flow prevention valves, when operation of the compressor stops, an inner space of the compression chamber is in a high-pressure state, but an inner space of the accumulator is in a relatively low-pressure state. Accordingly, refrigerant in the compression chamber and oil stored in an oil storage space in the compressor momentarily reversely flow through the compression chamber and the refrigerant suction pipe into the accumulator. In this case, although the refrigerant reversely flows into the accumulator, no problem occurs. However, when oil reversely flows into the accumulator, an oil amount in the compressor decreases, whereby various problems, such as deterioration of lubricating performance caused by occurrence of oil deficiency, may occur.

Further, in a structure of a conventional compressor, in which a valve uses a restoring force of a coil spring, malfunction or damage to the valve may occur due to torsion of the coil spring. In addition, in the conventional compressor, it is difficult to install the valve for preventing reverse flow of refrigerant and oil on the refrigerant discharge side of the refrigerant suction pipe (or the refrigerant inflow side of the compression chamber), in the inner space of the refrigerant suction pipe, or in the accumulator. Accordingly, installation and maintenance of the valve are difficult.

BRIEF DESCRIPTION OF THE DRAWINGS

Embodiments will be described in detail with reference to the following drawings in which like reference numerals refer to like elements, and wherein.

DETAILED DESCRIPTION

Figure 1:
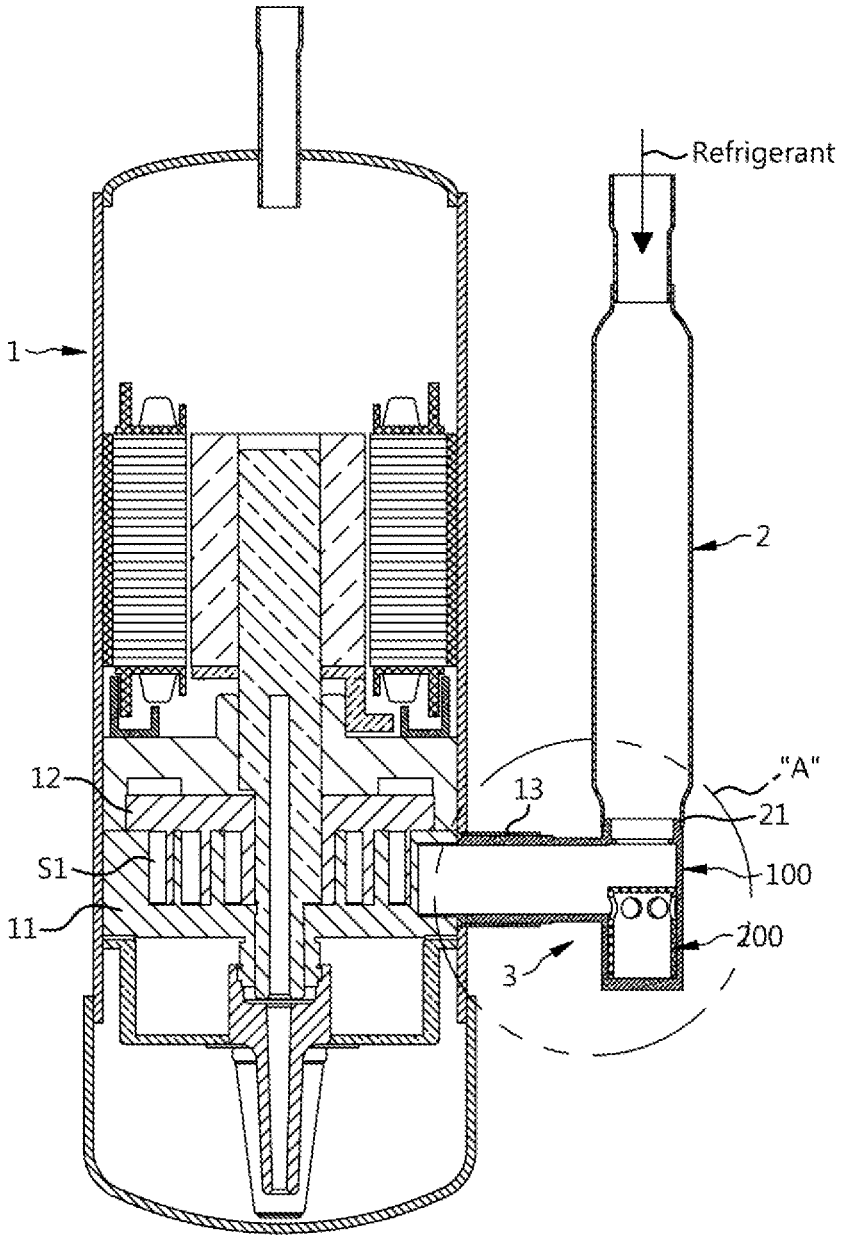
FIG. 1 is a schematic side cross-sectional view of a suction valve assembly of a compressor according to an embodiment.

Hereinbelow, embodiments of a suction valve assembly of a compressor will be described with reference to FIGS. 1 to 20. Wherever possible, the same or like reference numerals have been used to indicate the same or like elements, and repetitive disclosure has been omitted.

FIG. 1 is schematic side cross-sectional view of a suction valve assembly of a compressor according to an embodiment. As shown in FIG. 1, according to an embodiment, a compressor 1, which may be a scroll compressor, may be configured to allow refrigerant to be suctioned through a refrigerant suction pipe 13 formed through any one circumference of a fixed scroll 11 to a compression chamber S1 defined between the fixed scroll 11 and an orbiting scroll 12. The refrigerant may be supplied to the refrigerant suction pipe 13 after passing through an accumulator 2. The compression chamber S1 may include a portion through which the refrigerant is introduced into the fixed scroll 11.

Figure 2:
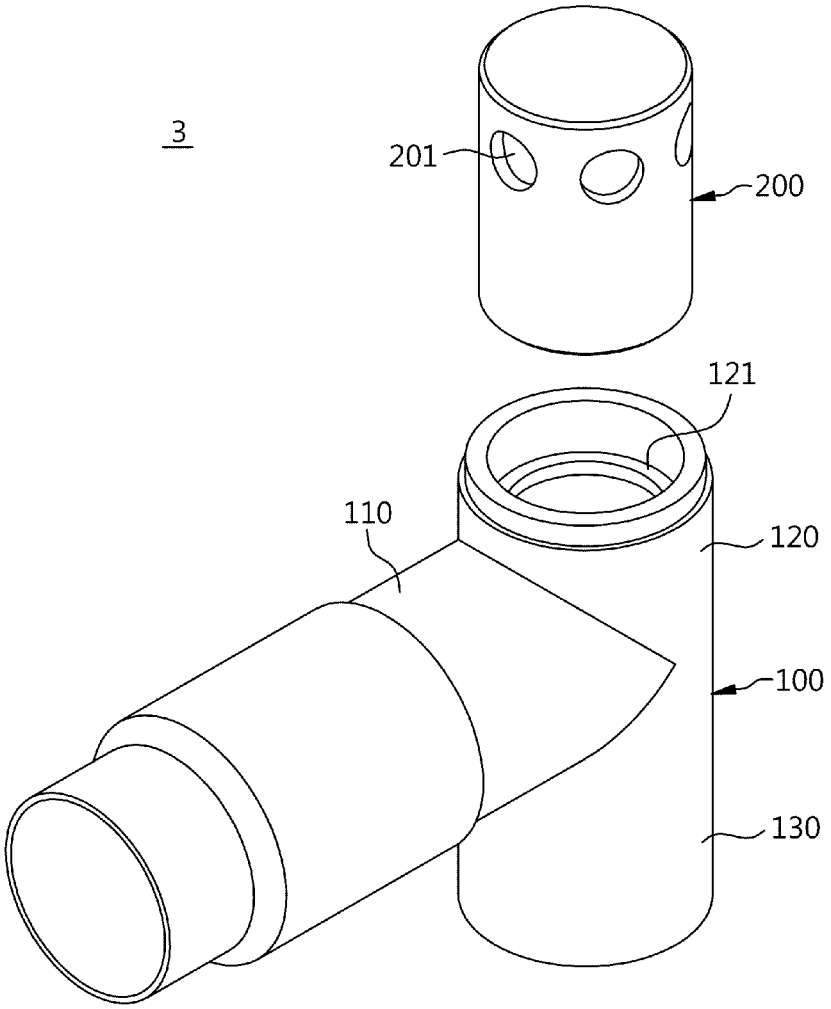
FIG. 2 is an exploded perspective view illustrating the suction valve assembly of the compressor according to an embodiment.
Figure 3:
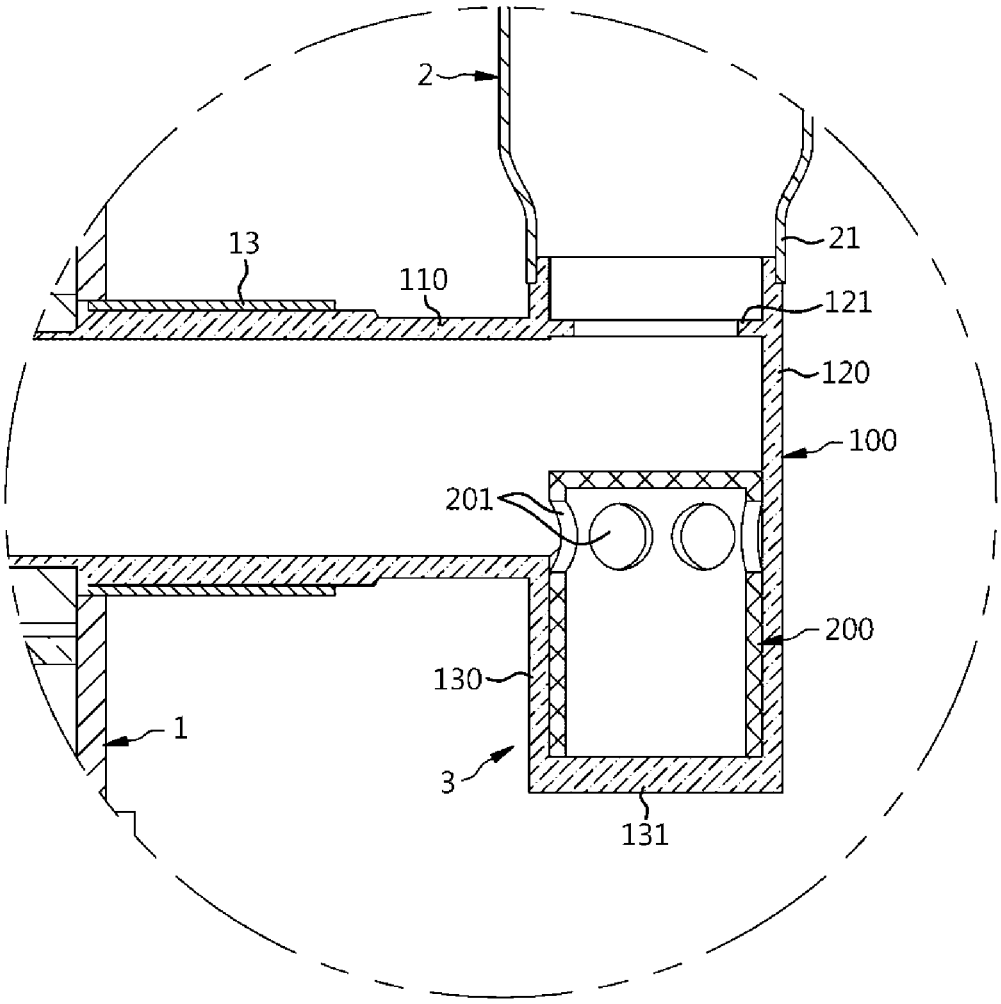
FIG. 3 is an enlarged view of a portion "A" of FIG. 1.

FIG. 2 is an exploded perspective view illustrating the suction valve assembly of the compressor according to an embodiment. FIG. 3 is an enlarged view of a portion "A" of FIG. 1.

As shown in the drawings, suction valve assembly 3 may include a body 100 and a lifting/lowering valve 200, and connect the compression chamber S1 of the compressor 1 with the accumulator 2 so as to guide refrigerant flow and prevent reverse flow of refrigerant and oil. The body 100 may form an outer surface of the suction valve assembly 3, and may be a pipe that allows refrigerant to flow along an inner space thereof.

The body 100 may include a horizontal pipe 110 and a vertical pipe 120. Thus, the body 100 may have a bending or branching structure.

The horizontal pipe 110 may extend horizontally so as to be connected to the compression chamber S1 of the compressor 1, and the vertical pipe 120 may extend upward from an end of the horizontal pipe 110 in a vertical direction. An upper end of the vertical pipe 120 may be connected to the accumulator 2. The horizontal pipe 110 may be configured to horizontally communicate with a circumference of the vertical pipe 120.

As shown in FIG. 1, the horizontal pipe 110 may be coupled with the refrigerant suction pipe 13 of the compressor 1 to supply refrigerant to the compression chamber S1. The vertical pipe 120 may be coupled with a refrigerant discharge pipe 21 of the accumulator 2 so as to receive refrigerant from the accumulator 2.

After the horizontal pipe 110 is, for example, press-fitted into and coupled with the refrigerant suction pipe 13, the horizontal pipe 110 may be coupled with the refrigerant suction pipe 13 by, for example, welding. After the vertical pipe 120 is, for example, press-fitted into and coupled with the refrigerant discharge pipe 21, the vertical pipe 120 may be coupled with the refrigerant discharge pipe 21 by, for example, welding. Accordingly, coupling of the vertical pipe 120 and the refrigerant discharge pipe 21 with each other may be stably performed.

Alternatively, although not shown, the horizontal pipe 110 and the vertical pipe 120 may be screwed to or variously coupled with an inner space of the refrigerant suction pipe 13 and an inner space of the refrigerant discharge pipe 21, respectively.

Figure 4:
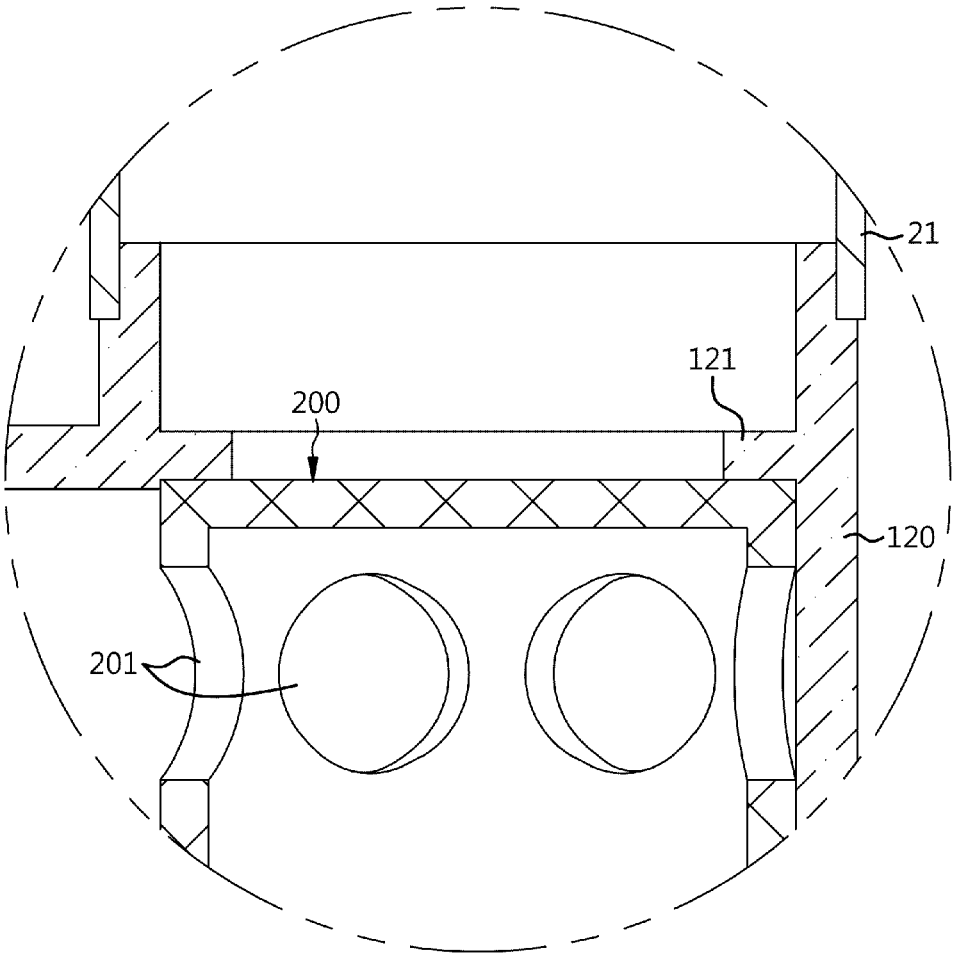
FIG. 4 is an enlarged view illustrating an example of a limiting member of the suction valve assembly of the compressor according to an embodiment.

The vertical pipe 120 may include a limiting member 121 provided therein. The limiting member 121 may limit an upward moving distance of lifting/lowering valve 200. More particularly, as shown in FIG. 4, the limiting member 121 may be a ring-shaped protrusion that protrudes from an inner circumferential surface of the vertical pipe 120 along an inner circumferential surface.

Figure 5:
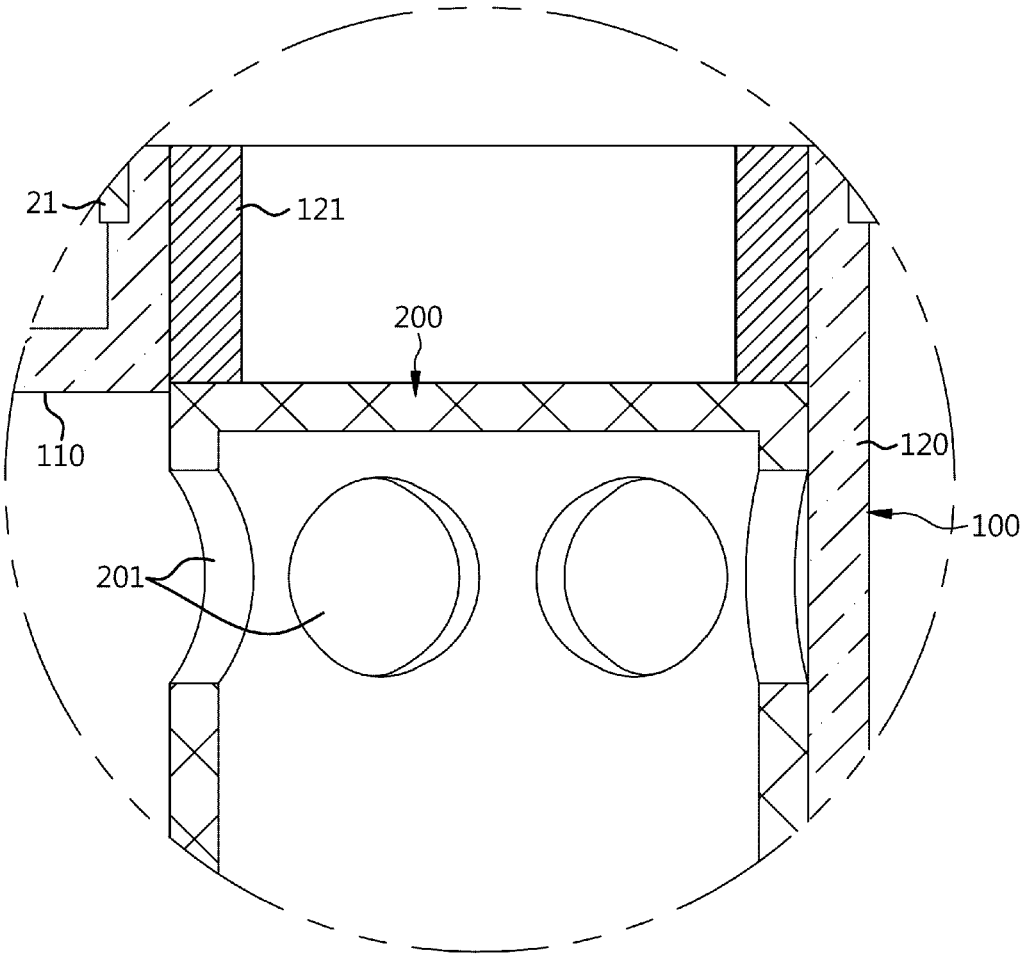
FIG. 5 is an enlarged view illustrating another example of the limiting member of the suction valve assembly of the compressor according to an embodiment.
Figure 6:
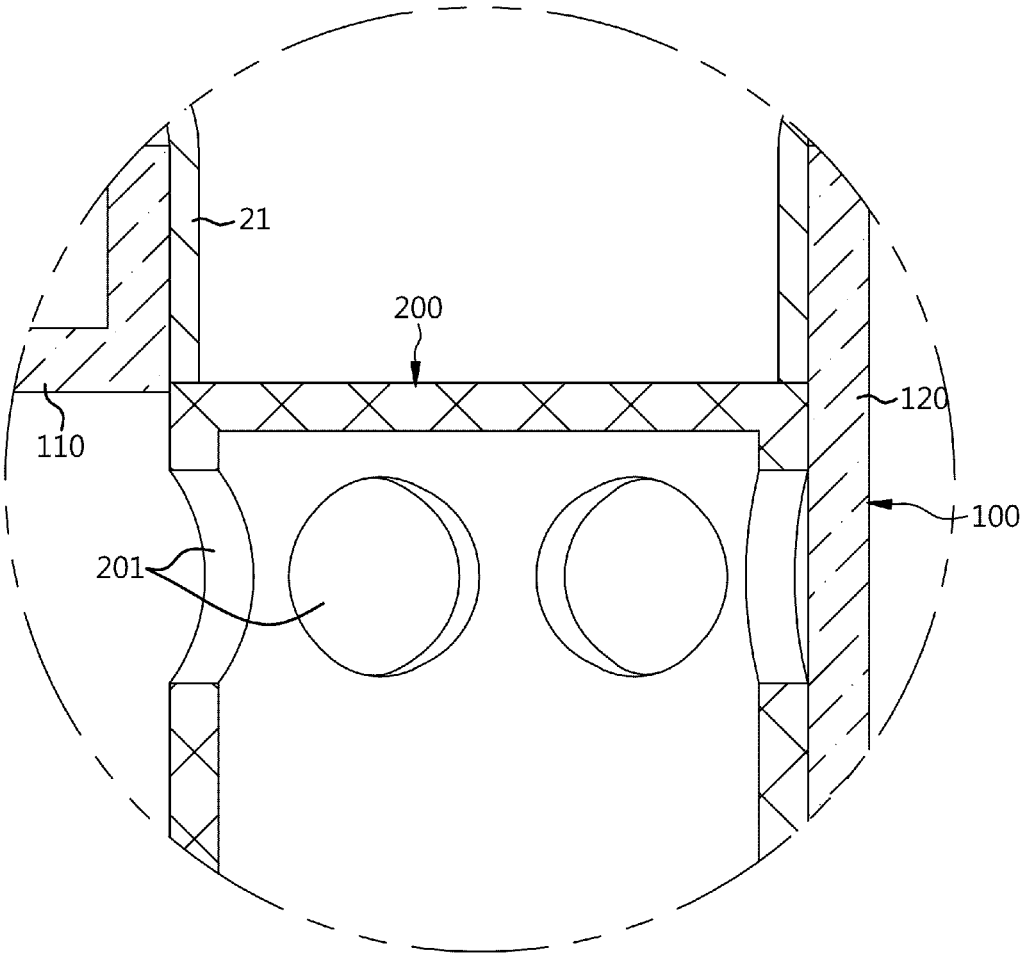
FIG. 6 is an enlarged view illustrating still another example of the limiting member of the suction valve assembly of the compressor according to an embodiment.

As shown in FIG. 5, the limiting member 121 may be a ring-shaped member press-fitted into and fixed to the vertical pipe 120, while provided independently of the vertical pipe 120 or the refrigerant discharge pipe 21. In addition, as shown FIG. 6, the refrigerant discharge pipe 21 may be, for example, press-fitted into the vertical pipe 120 such that an end portion or end of the refrigerant discharge pipe 21 performs a function of the limiting member 121. Although not shown, the limiting member 121 may be a protrusion that protrudes from an inner circumferential surface of the refrigerant discharge pipe 21 of the accumulator 2.

A protruding distance of the limiting member 121 to an inner space of the vertical pipe 120 is required not to be excessively long to a degree to prevent the refrigerant flow or excessively short to a degree capable of being damaged by repetitive collisions with the lifting/lowering valve 200. Accordingly, in this embodiment, the protruding distance of the limiting member 121 (a protruding distance toward the inner space of the vertical pipe 120) is provided to block 5~20% of a portion adjacent to a circumference of an upper surface of the lifting/lowering valve 200.

The body 100 may be formed of iron or brass, for example. That is, in consideration of a case in which the body 100 is coupled with the refrigerant suction pipe 13 or the refrigerant discharge pipe 21 by welding, the body 100 may be formed of a material suitable to welding.

The body 100 may further include a protruding pipe 130. The protruding pipe 130 is a structure provided to guide lifting/lowering movements of the lifting/lowering valve 200, which will be described hereinafter.

The protruding pipe 130 may be positioned immediately under the vertical pipe 120, that is, immediately under a bent connection portion between the horizontal pipe 110 and the vertical pipe 120 forming the body 100, and may be a pipe that extends in a direction opposite to a direction in which the vertical pipe 120 extends. An upper surface of the protruding pipe 130 may be open toward the inner space of the vertical pipe 120. In this case, a protruding height of the protruding pipe 130 may be determined by considering a height of the lifting/lowering valve 200, which will be described hereinafter.

The protruding pipe 130 may have a lower wall 131 such that a lower portion thereof is closed. That is, the protruding pipe 130 may be configured such that an inner space of the protruding pipe 130 is blocked from an external environment by the lower wall 131.

Figure 7:
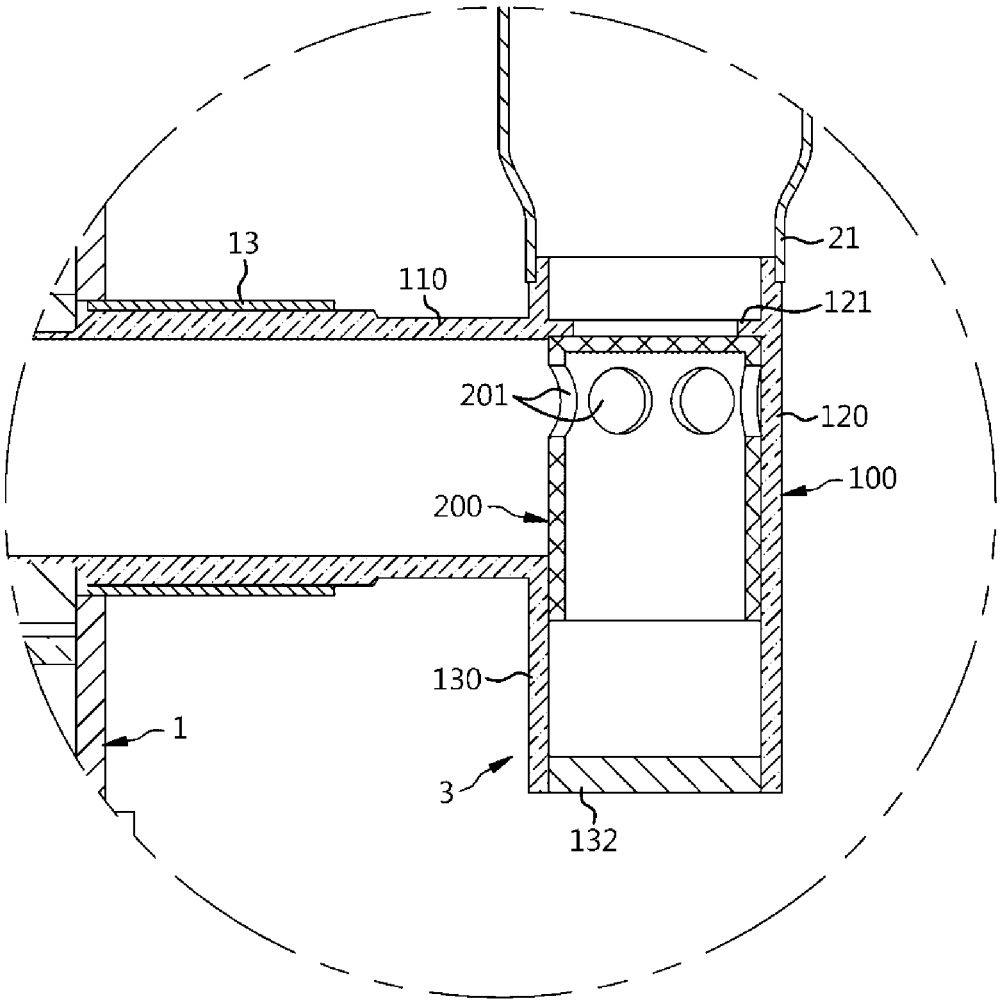
FIG. 7 is a schematic side cross-sectional view illustrating another example of a protruding pipe of the suction valve assembly of the compressor according to an embodiment.

Alternatively, the protruding pipe 130 may be a pipe body having open upper and lower portions without the lower wall 131. The open lower portion may include a cover 132 thereon so as to be opened and closed. Accordingly, when required, the inner space of the protruding pipe 130 may be opened so as to replace the lifting/lowering valve 200. This is shown in FIG. 7.

The lifting/lowering valve 200 may be configured to selectively open and close a flow path in the body 100. The lifting/lowering valve 200 may be provided at a communicating portion, which is connected by bending, positioned between the horizontal pipe 110 and the vertical pipe 120 forming the body 100 so as to open and close the communicating portion between the horizontal pipe 110 and the vertical pipe 120. More particularly, during operation of the compressor 1, the lifting/lowering valve 200 may be moved downward by weight so as to open the communicating portion between the horizontal pipe 110 and the vertical pipe 120, and when operation of the compressor 1 stops, the lifting/lowering valve 200 may be moved upward by a pressure difference between the accumulator 2, that is, the inner space of the accumulator, and the compression chamber S1, that is, an inner space of the compression chamber S1, so as to close the communicating portion between the vertical pipe 120 and the refrigerant discharge pipe 21.

In one embodiment, the lifting/lowering valve 200 may be a pipe body having an upper surface, which is closed, and a lower surface, which is open. According to one embodiment, the lifting/lowering valve 200 may have a cylindrical shape having a circular cross-section (see FIG. 9). Alternatively, the lifting/lowering valve 200 may have a cross-section of an oval shape (see FIG. 10), a rounded rectangle shape (see FIG. 11), or a polygonal shape (see FIG. 12).

Figure 12:
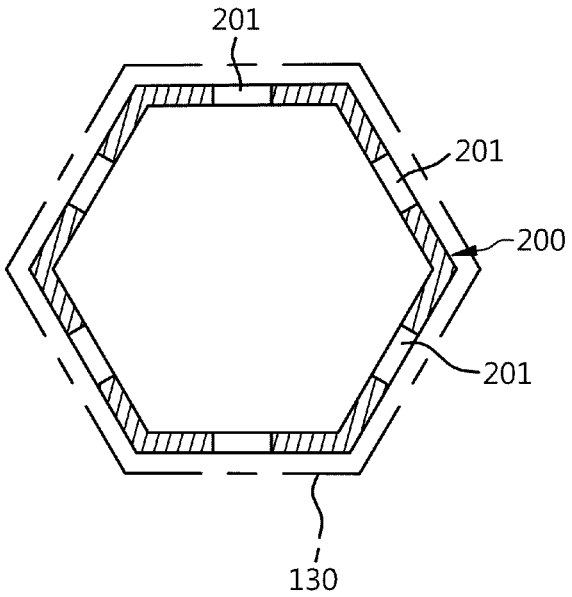

In addition, at least a portion between an outer circumferential surface of the lifting/lowering valve 200 and an inner circumferential surface of the protruding pipe 121 may be provided to be in surface contact. For example, as shown in FIG. 12, in a polygonal structure of the lifting/lowering valve, the inner circumferential surface of the protruding pipe 121 may be formed to have a same polygonal structure as the structure of the lifting/lowering valve 200. Due to such a surface contact structure, the lifting/lowering valve 200 does not rotate in the protruding pipe 121 and may perform accurate lifting and lowering movements.

Figure 8:
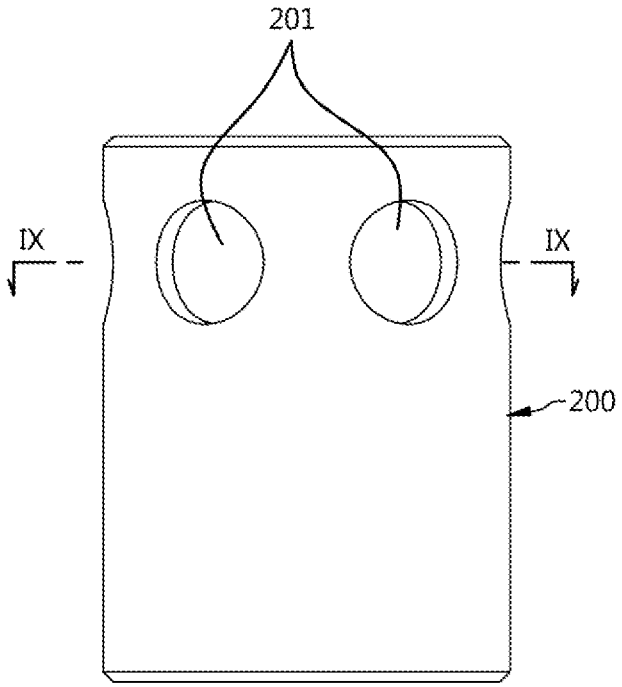
FIG. 8 is a front view illustrating a lifting/lowering valve of the suction valve assembly of the compressor according to an embodiment.
Figure 9:
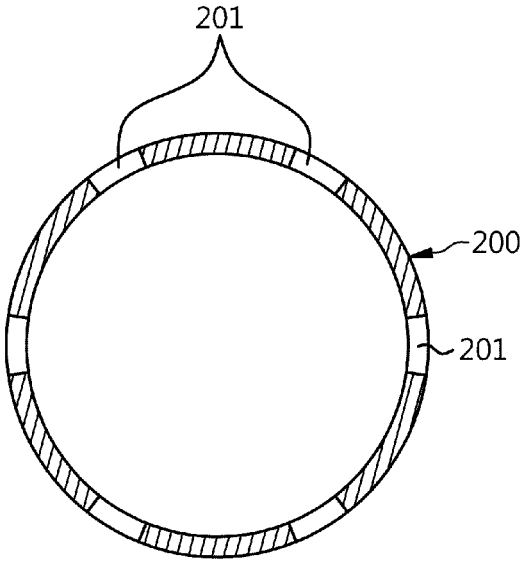
FIG. 9 is a cross-sectional view, taken along line IX-IX of FIG. 8.
Figure 10:
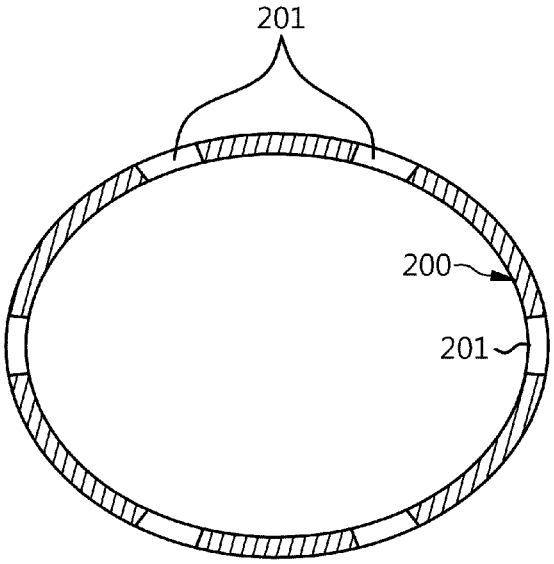
FIGS. 10 to 12 are cross-sectional views illustrating various examples of the lifting/lowering valve of the suction valve assembly of the compressor according to an embodiment.
Figure 11:
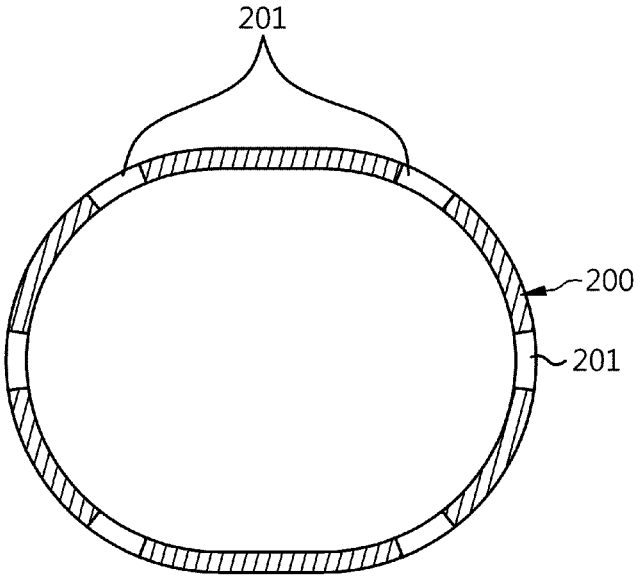

In addition, according to one embodiment, the lifting/lowering valve 200 may include one or more communicating holes 201 provided on a circumferential surface thereof, each of the communicating holes communicating with an inner space of the horizontal pipe 110. This is shown in FIG. 8.

Figure 13:
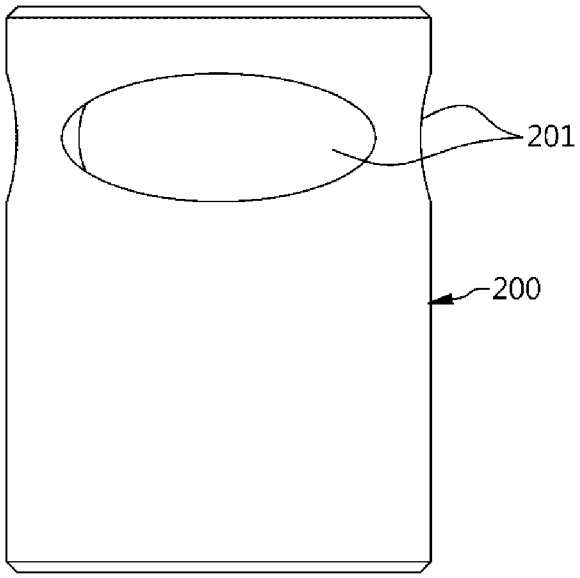
FIG. 13 is a front view illustrating another example of a communicating hole of the lifting/lowering valve of the suction valve assembly of the compressor according to an embodiment.
Figure 14:
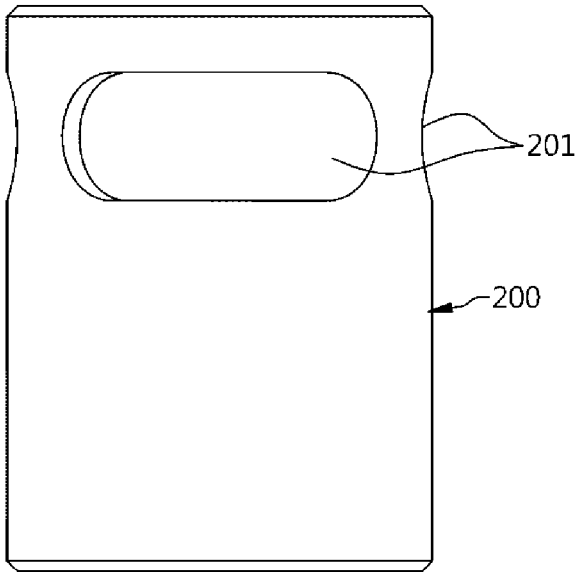
FIG. 14 is a view illustrating still another example of the communicating hole of the lifting/lowering valve of the suction valve assembly of the compressor according to an embodiment.

Each communicating hole 201 may have a circular shape. A plurality of communicating holes 201 may be provided along a circumferential direction of the lifting/lowering valve 200. Alternatively, the communicating hole 201 may have an oval shape, as shown in FIG. 13, or a rounded rectangle shape, as shown in FIG. 14.

Although not shown, alternatively, the communicating hole 201 may have a non-circular shape other than the oval shape or the rounded rectangle shape. However, according to this embodiment, the communicating hole 201 is formed to have a round-shaped structure having an edge removed to a maximum such that during refrigerant flow, a vortex, which may occur due to a portion of the edge, is minimized.

The lifting/lowering valve 200 may be configured such that lifting and lowering movements thereof are guided by the protruding pipe 130 while at least a portion of the lifting/lowering valve 200 is positioned in the protruding pipe 130. The lifting/lowering valve 200 may have a height to a degree that a portion of an upper portion of the lifting/lowering valve 200 protrudes from the protruding pipe 130 and a remaining portion thereof is positioned in the protruding pipe 130 (see FIG. 3). Further, the lifting/lowering valve 200 may have a height such that at least a portion of the lifting/lowering valve 200 is received in the protruding pipe 130 (see FIG. 20) when the lifting/lowering valve 200 is moved upward by the pressure difference between the inner space of the compression chamber S1 and the inner space of the accumulator 2 when operation of the compressor 1 stops. In addition, an outer diameter of the lifting/lowering valve 200 may be larger than an inner diameter of the limiting member 121 and smaller than an inner diameter of the protruding pipe 130.

In addition, each of the communicating holes 201 provided in the lifting/lowering valve 200 may be provided along a circumference of an upper end of the lifting/lowering valve 200. During operation of the compressor 1, at least a portion of the communicating holes may be positioned so as to communicate with the inner space of the horizontal pipe 110 (see FIG. 3). That is, although a remaining portion of the lifting/lowering valve 200 except for a portion of an upper portion thereof is received in the protruding pipe 130 as the compressor 1 operates, each of the communicating holes 201 may communicate with the inner space of the horizontal pipe 110, whereby when operation of the compressor 1 stops, the lifting/lowering valve 200 may be quickly moved upward by sufficient provision of pressure of refrigerant reversely flowing to the vertical pipe 120 from the horizontal pipe 110.

At least a half of each of the communicating holes 201 may be positioned so as to communicate with the inner space of the horizontal pipe 110. In addition, a height of the lifting/lowering valve 200 protruding from the protruding pipe 130 or a height of the lifting/lowering valve 200 may be determined such that a flow path cross-sectional area of the communicating portion between the lifting/lowering valve 200 received in the protruding pipe 130 and the horizontal pipe 110 is the same as or larger than a minimum cross-sectional area of the accumulator 2. Such a structure may be provided such that refrigerant provided from the accumulator 2 may be prevented from leaking in a process of passing by a portion at which the lifting/lowering valve 200 is positioned.

A lower surface of the limiting member 121 and an upper surface of the lifting/lowering valve 200 may be configured to be in surface contact. That is, the limiting member 121 and the lifting/lowering valve 200 may be configured to be in surface contact with each other so as to maintain stable sealing therebetween.

Figure 15:
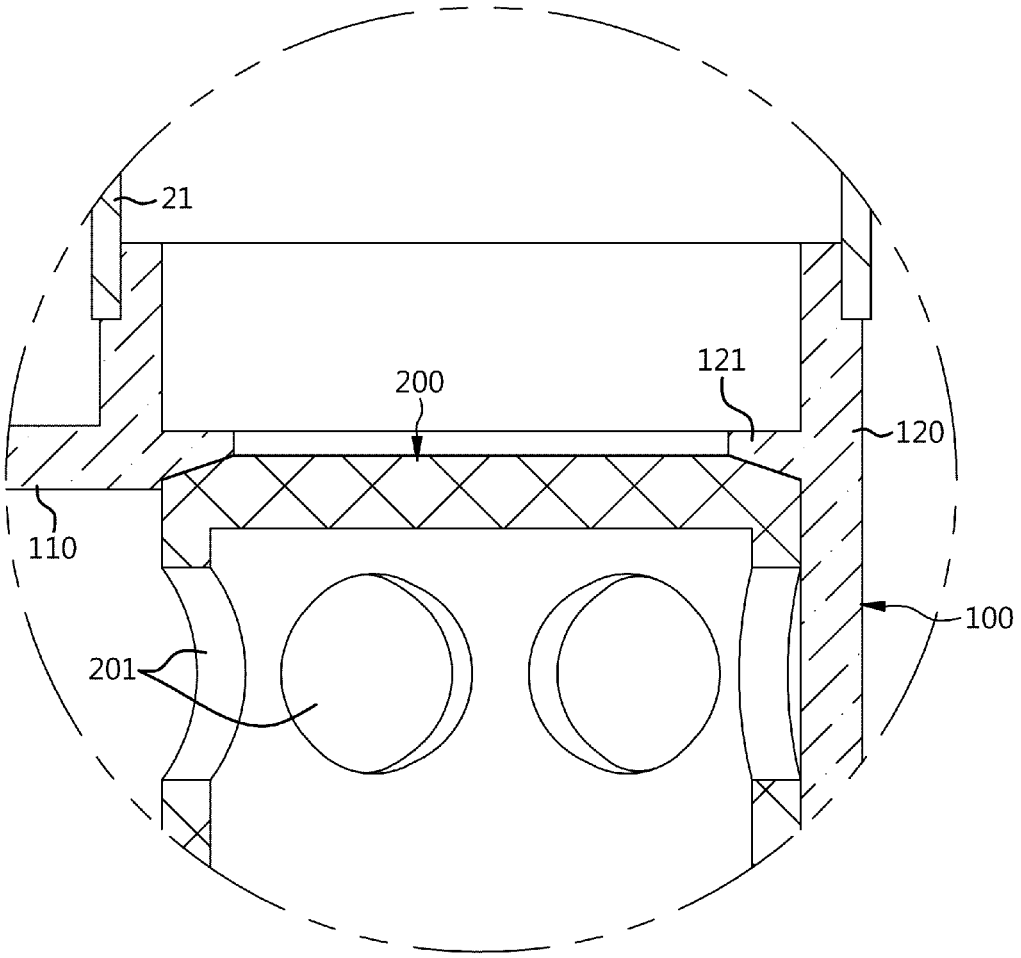
FIG. 15 is a view illustrating another example of a surface contact structure of the limiting member and the lifting/lowering valve of the suction valve assembly of the compressor according to an embodiment.

The structure of the surface contact may be variously formed, and in one embodiment, a contact portion between the lower surface of the limiting member 121 and the upper surface of the lifting/lowering valve 200 facing the lower surface may be formed to be a plane such that the lower surface of the limiting member 121 and the upper surface of the lifting/lowering valve 200 are in surface contact with each other. This is shown in FIG. 4. The limiting member 121 may be configured to contact around 5-20% of an entire area of the upper surface of the lifting/lowering valve 200 so as to prevent excessive blocking of the flow path and damage which may be caused by repetitive collisions of the lifting/lowering valve 200 with the limiting member 121 or by pressure of the lifting/lowering valve 200 applied to the limiting member 121. Alternatively, as shown in FIG. 15, each of the lower surface of the limiting member 121 and the upper surface of the lifting/lowering valve 200 may be formed to have a slanted surface, or may be formed to have a rounded surface, which is not shown.

In addition, an edge portion or edge of the upper surface of the lifting/lowering valve 200 may have a chamfer which is slanted or rounded (see FIGS. 2 and 8). This structure is intended to prevent damage (damage to the vertical pipe or damage of the lifting/lowering valve) caused by the edge of the upper surface of the lifting/lowering valve 200 hitting the vertical pipe 120 when the lifting/lowering valve 200 is received into the vertical pipe 120 of the body 100.

Figure 16:
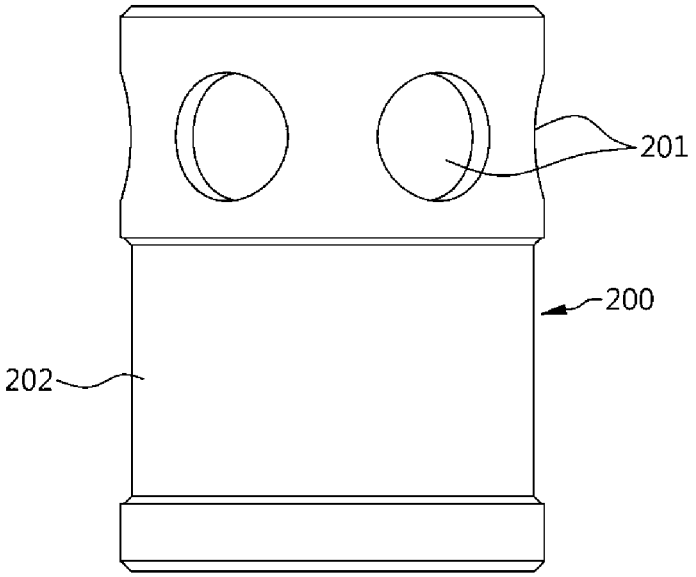
FIG. 16 is a front view illustrating another example of the lifting/lowering valve of the suction valve assembly of the compressor according to an embodiment.

An escape groove 202 may be concavely formed on an outer circumferential surface of the lifting/lowering valve 200 (FIG. 16). The escape groove 202 may be provided in such a manner that a lower portion of a portion at which each of the communicating holes 201 is positioned on the outer circumferential surface of the lifting/lowering valve 200 is configured to have a step compared to other portions thereof, whereby during movement of the lifting/lowering valve 200, oil resistance which may be caused by oil between the outer circumferential surface of the lifting/lowering valve 200 and an inner circumferential surface of the protruding pipe 130 may be reduced. This is shown in FIG. 16.

Hereinbelow, operation of suction valve assembly 3 according to an embodiment will be described with reference to FIGS. 17 to 20.

Figure 17:
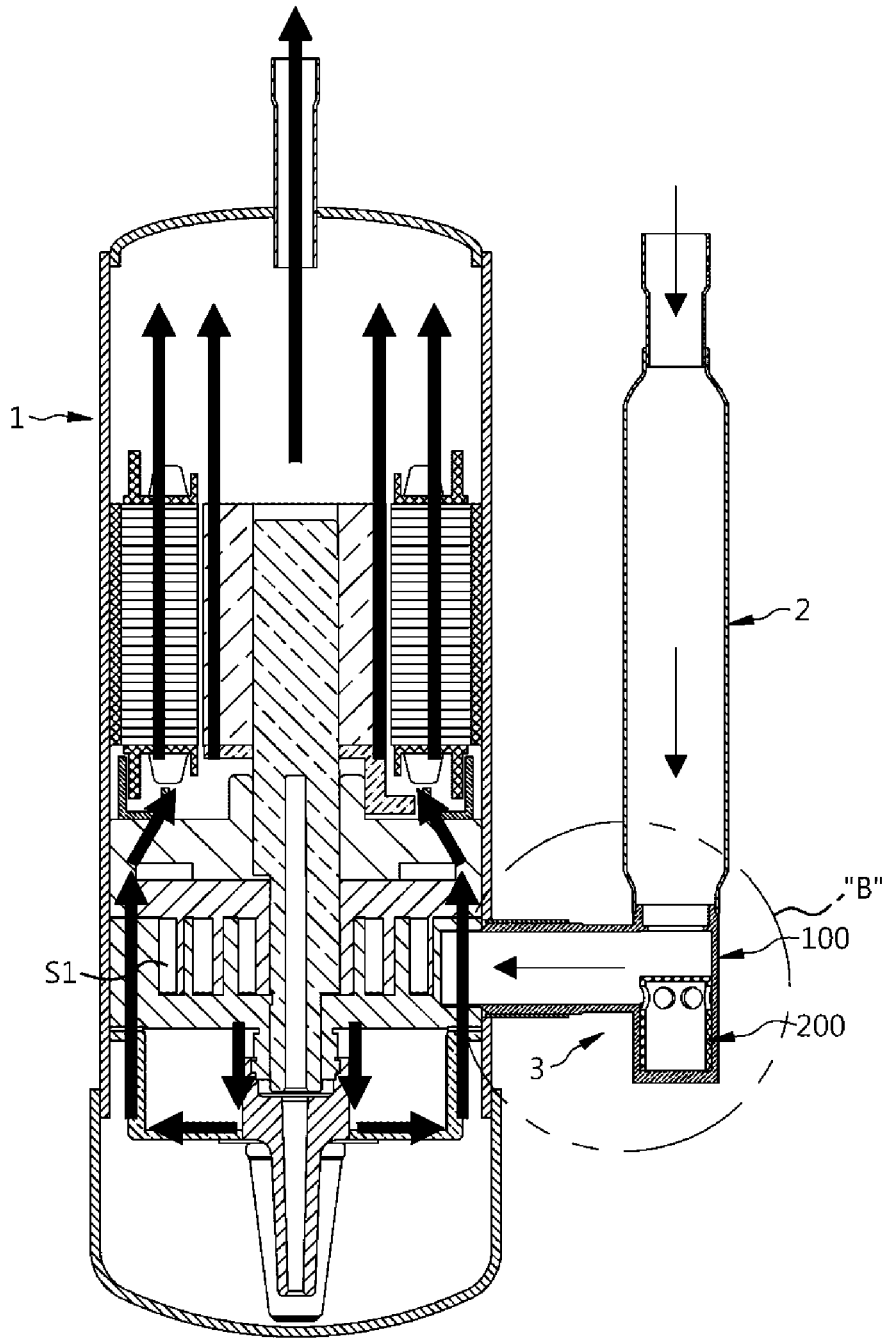
FIG. 17 is a schematic side cross-sectional view illustrating a state of operation of the compressor of the suction valve assembly of the compressor according to an embodiment.
Figure 18:
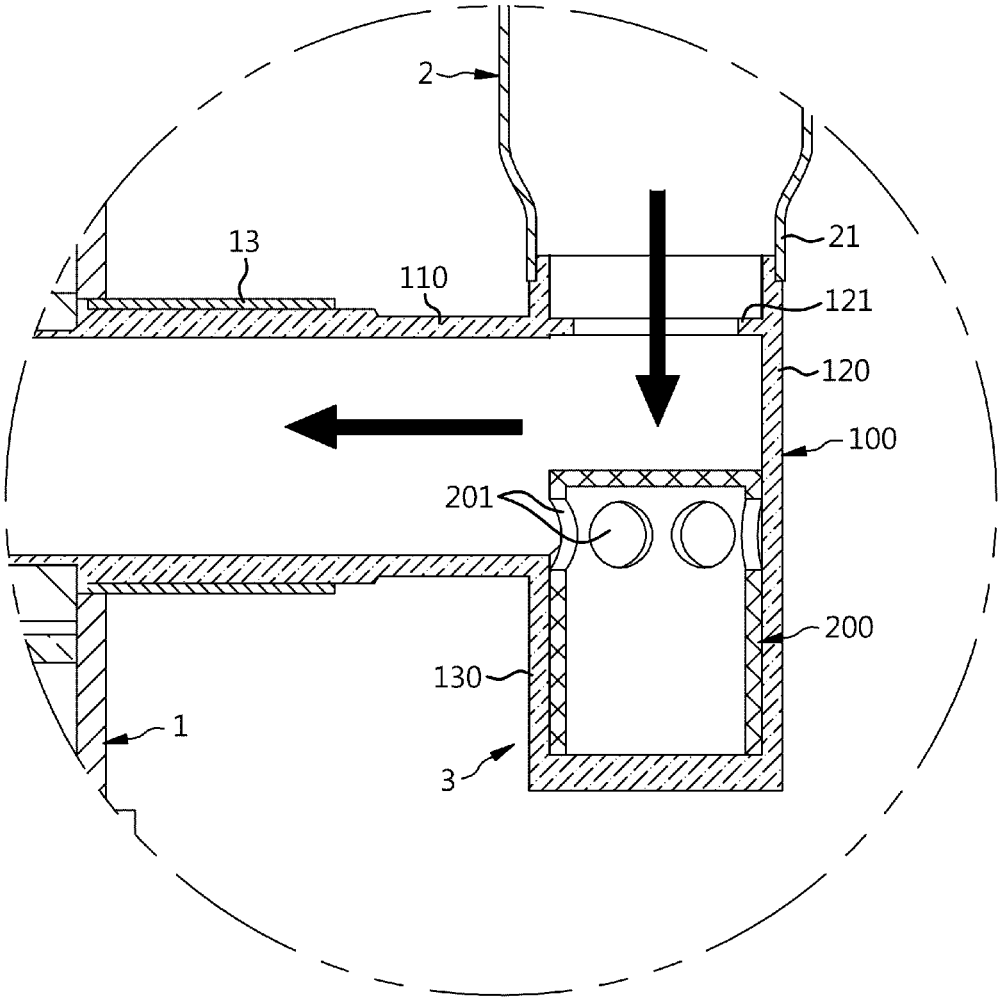
FIG. 18 is an enlarged view of a portion "B" of FIG. 17.

As shown in FIG. 17, when the compressor operates, refrigerant passing through the accumulator 2 is supplied through the refrigerant discharge pipe 21 into the vertical pipe 120 of the body 100 and is continuously supplied through the horizontal pipe 110 into the compression chamber S1. The lifting/lowering valve 200 provided between the vertical pipe 120 and the horizontal pipe 110 is positioned to be received in the protruding pipe 130 (see FIGS. 17 and 18) by flow pressure of refrigerant introduced from the accumulator 2 such that the communicating portion between the horizontal pipe 110 and the vertical pipe 120 may be open. Although the lifting/lowering valve 200 is received in the protruding pipe 130, a portion of the upper portion of the lifting/lowering valve 200 protrudes from the protruding pipe 130 and a plurality of communicating holes 201 formed along the circumference thereof communicate with the inner space of the horizontal pipe 110.

As described above, when a refrigeration cycle is stopped by a periodical or selective operation control during operation of the compressor 1 or when operation of the compressor 1 stops, refrigerant compression is no longer performed and refrigerant supply from the accumulator 2 is stopped. As the compression chamber S1 is in a high-pressure state but the inner space of the accumulator 2 is in a relative low-pressure state compared to the compression chamber S1, the high-pressure refrigerant in the compression chamber S1 reversely flows into the accumulator 2 due to such pressure difference. In this process, oil in the compressor 1 reversely flows to the accumulator 2 along with or following the high-pressure refrigerant due to counterpressure supplied during the reverse flow of the refrigerant.

However, during the reverse flow of refrigerant and oil as described above, the lifting/lowering valve 200 moves upward while a portion of the refrigerant reversely flowing prior to the oil is introduced through the communicating holes 201 exposed to the inner space of the horizontal pipe 110 into the lifting/lowering valve 200. More particularly, the inner space of the protruding pipe 130 is also in a high-pressure state due to impact of the high-pressure of the reverse flow, and accordingly, the lifting/lowering valve 200 more efficiently moves upward.

Figure 19:
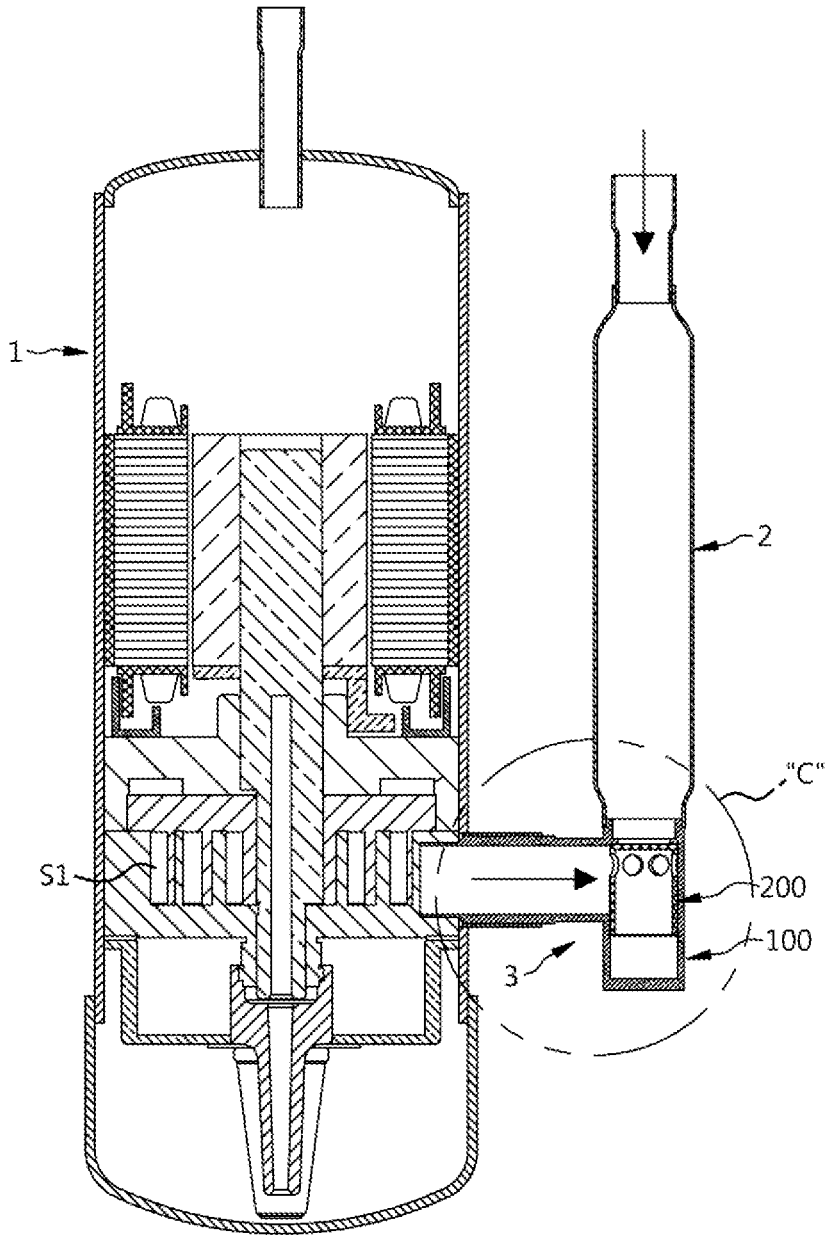
FIG. 19 is a schematic side cross-sectional view illustrating a state in which operation of the compressor of the suction valve assembly of the compressor according to an embodiment stops.
Figure 20:
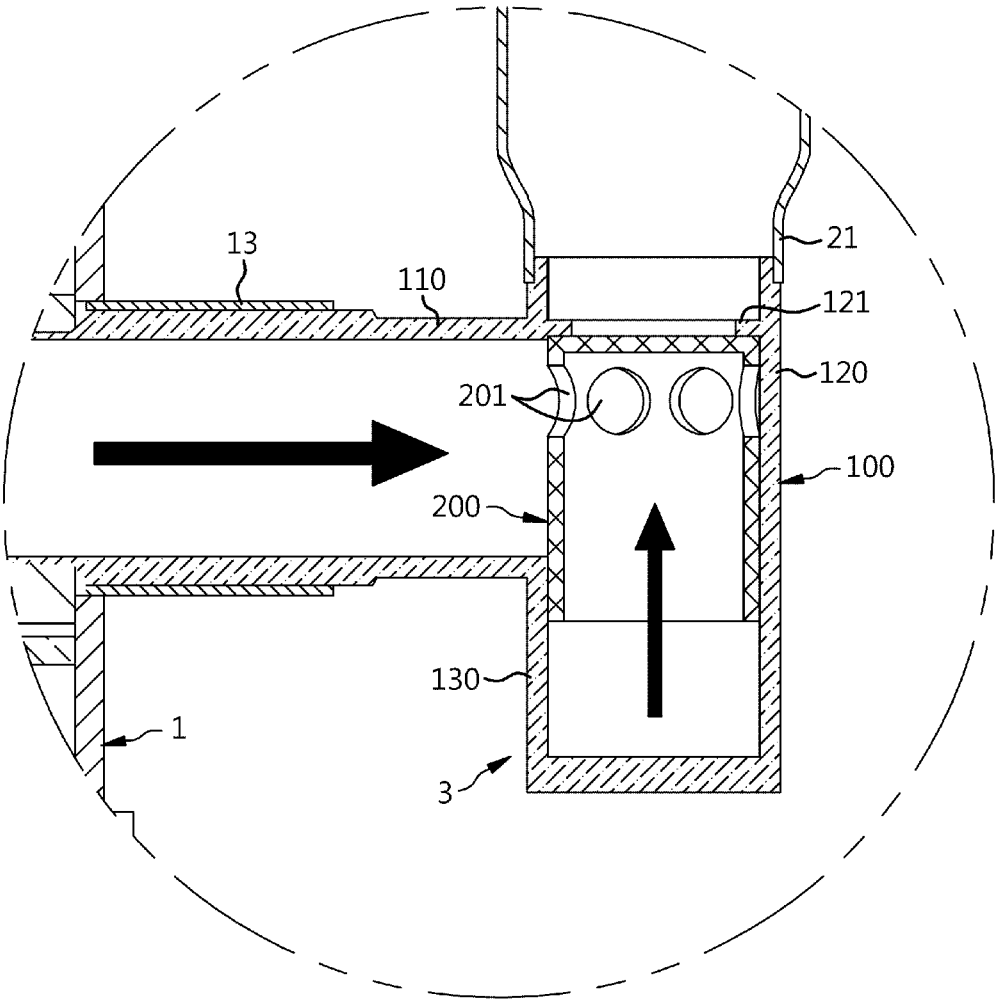
FIG. 20 is an enlarged view of a portion "C" of FIG. 19.

Accordingly, when the lifting/lowering valve 200 moves upward and is in surface contact with the limiting member 121, the vertical pipe 120 is in a closed state. Accordingly, further reverse flow of refrigerant is prevented and the oil reversely flowing along with or following the refrigerant does not pass through the vertical pipe 120 so as to be prevented from being discharged to the accumulator 2. This is shown in FIGS. 19 and 20.

Of course, a portion of the oil may be introduced into the protruding pipe 130, but together with refrigerant in the accumulator 2, the oil remaining in the protruding pipe 130 after being introduced thereinto is reintroduced into the compression chamber S1 by suction pressure supplied by the compression chamber S1 during subsequent reoperation of the compressor 1, and then cools and lubricates sliding portions in the compressor 1.

The suction valve assembly 3 according to embodiments is provided in a flow path guiding a refrigerant flow between the compressor 1 and the accumulator 2 so as to close the flow path when operation of the compressor 1 stops, whereby oil in the compressor 1 is prevented from leaking. In addition, in the suction valve assembly 3 according to embodiments, lifting and lowering movements of the lifting/lowering valve 200 are performed by weight and the pressure difference existing between the inner space of the compression chamber S1 and the inner space of the accumulator 2, whereby difficulty of maintenance caused by damage of an elastic member which may be caused by application of the elastic member, such as a coil spring, may be solved.

Further, in the suction valve assembly 3 according to embodiments, the lifting/lowering valve 200 may be lifted and lowered by being guided by the protruding pipe 130 while the lifting/lowering valve 200 is received in the protruding pipe 130, whereby the lifting and lowering movements may be stably performed. Furthermore, in the suction valve assembly 3 according to embodiments, the lifting/lowering valve 200 may protrude from the protruding pipe 130 so as to optimize a height of the valve exposed to a space positioned between the horizontal pipe 110 and the vertical pipe 120, whereby loss of the amount of introduced refrigerant may be prevented.

In addition, in the suction valve assembly 3 according to embodiments, the lifting/lowering valve 200 may be provided as the pipe body having a closed upper surface and the one or more communicating holes 201 provided in the circumferential surface of the upper end thereof, whereby the lifting/lowering valve 200 may be efficiently moved upward by pressure of refrigerant reversely flowing. Also, in the suction valve assembly 3 according to embodiments, at least the half of each of the communicating holes 201 formed in the lifting/lowering valve 200 may communicate with the inner space of the horizontal pipe 110. Accordingly, when refrigerant reversely flows due to the pressure difference between the compressor 1 and the accumulator 2 during stopping of operation of the compressor 1, the pressure of the refrigerant reversely flowing may be efficiently supplied to the lifting/lowering valve 200, whereby the lifting/lowering valve 200 may efficiently move upward and downward.

Additionally, in the suction valve assembly 3 according to embodiments, a height of the lifting/lowering valve 200 protruding from the protruding pipe 130 or a height of the lifting/lowering valve 200 may be determined such that while the lifting/lowering valve is received in the protruding pipe 130, the cross-sectional area of the communicating portion between the lifting/lowering valve 200 and the horizontal pipe 110 may be the same as or larger than the cross-sectional area of the lifting/lowering valve 200 in the vertical pipe 120. Accordingly, loss of the amount of the introduced refrigerant may be prevented.

In addition, in the suction valve assembly 3 according to embodiments, as the limiting member 121 may be provided in the vertical pipe 120 forming the body 100, the upward moving distance of the lifting/lowering valve 200 may be limited. More particularly, the limiting member 121 may have various forms, such as a ring-shaped protrusion, provided by protruding from the inner circumferential surface of the vertical pipe 120 or the refrigerant discharge pipe 21 along the inner circumferential surface, or an additional ring-shaped member.

Further, in the suction valve assembly 3 according to embodiments, as the contact portion between the lower surface of the limiting member 121 and the upper surface of the lifting/lowering valve 200 is provided to have a plane or a slanted surface such that the lower surface and the upper surface correspond to each other so as to be in surface contact with each other, sealing maintenance may stably performed during contact therebetween and the lifting/lowering valve 200 may stop at an accurate position.

Additionally, in the suction valve assembly 3 according to embodiments, the chamfer may be provided on the edge portion of the upper surface of the lifting/lowering valve 200, whereby during operation, damage which may occur on the lifting/lowering valve 200 or the limiting member 121 may be minimized. In addition, in the suction valve assembly 3 according to embodiments, as the lower surface of the protruding pipe 130 may be closed, oil may be momentarily stored, and later the momentarily stored oil, together with refrigerant, may be supplied again into the compressor 1 when operation of the compressor 1 restarts, whereby deficiency of oil in the compressor 1 may be prevented.

Further, in the suction valve assembly 3 according to embodiments, the lower surface of the lower surface of the protruding pipe 130 may be open. The lower surface of the open protruding pipe 130 may have the closing cover 132 provided thereon to be opened and closed. Accordingly, the lifting/lowering valve 200 may be replaced when required, and thus, maintenance becomes easy.

Additionally, the suction valve assembly 3 according to embodiments may be provided independently of the refrigerant suction pipe 13 of the compressor 1 and the refrigerant discharge pipe 21 of the accumulator 2 so as to be connected to each of the refrigerant suction pipe 13 and the refrigerant discharge pipe 21, and accordingly, manufacturing thereof may be easy.

The suction valve assembly 3 according to embodiments is not limited to be applied just to a scroll compressor. That is, the suction valve assembly may also be applied to a rotary compressor, although not shown. Accordingly, the suction valve assembly of the compressor according to embodiments may be variously applied.

Embodiments disclosed herein have been made keeping in mind problems occurring in the related art, and embodiments disclosed herein provide a suction valve assembly of a compressor, wherein when operation of a compressor stops, a connection portion between a refrigerant suction pipe and an accumulator may be quickly and accurately closed, so that reverse flow of oil may be prevented.

In addition, embodiments disclosed herein provide a suction valve assembly of a compressor, wherein when operation of the compressor stops, a flow path may be quickly closed by a pressure difference between the refrigerant suction pipe and the accumulator and when operation of the compressor restarts, the flow path may be quickly opened by weight and pressure of suctioned refrigerant.

Further, embodiments disclosed herein provide a suction valve assembly of a new type compressor, wherein installation and maintenance thereof may be efficiently performed. Additionally, embodiments disclosed herein provide a suction valve assembly of a compressor, wherein during operation of the compressor, refrigerant loss which may occur in a suction process of refrigerant may be prevented so that performance deterioration of the compressor is prevented and when operation of the compressor stops, a flow path may be quickly closed.

Embodiments disclosed herein provide a suction valve assembly of a compressor that may include a body part or body that connects a compression chamber of the compressor with an accumulator, and a lifting/lowering valve provided in the body part. The lifting/lowering valve may be moved upward by a pressure difference between an inner part or space of the accumulator and an inner part or space of the compression chamber when operation of the compressor stops and block a connection portion between the body part and the accumulator so as to prevent a reverse flow of oil to the accumulator. Accordingly, when operation of the compressor stops, compressed oil may be prevented from reversely flowing to the accumulator.

The suction valve assembly may further include a protruding pipe to guide movement of the lifting/lowering valve, whereby the lifting/lowering valve may move stably due to the protruding pipe. In this case, a lower part or portion of the protruding pipe may be configured to be closed or selectively opened.

In addition, according to embodiments disclosed herein, the lifting/lowering valve may be a pipe body and include one or more communicating holes provided along a circumference thereof, whereby the lifting/lowering valve may be efficiently moved upward by the pressure difference between the accumulator and the compression chamber. The lifting/lowering valve may be a pipe body of a cylindrical shape having a circular cross-section, or a pipe body having a cross-section of any one of an oval shape, a rounded rectangle shape, or a polygonal shape. Each of the communicating holes may be formed to be a circular hole or a non-circular hole.

At least a portion between an outer circumferential surface of the lifting/lowering valve and an inner circumferential surface of the protruding pipe may be provided to be in surface contact. Further, according to embodiments disclosed herein, an escape groove may be concavely formed on an outer circumferential surface of the lifting/lowering valve, whereby while the lifting/lowering valve lifts or lowers in the protruding pipe, a contact area between the lifting/lowering valve and the inner circumferential surface of the protruding pipe may be reduced so as to decrease oil resistance.

Additionally, according to embodiments disclosed herein, a distance of the lifting/lowering valve protruding from the protruding pipe and a range of the communicating hole exposed to an inner part or space of the horizontal pipe may be limited such that the lifting/lowering valve may efficiently move upward from the protruding pipe and during operation of the compressor, an amount of introduced refrigerant is not influenced, whereby compression efficiency may be prevented from decreasing.

In addition, according to embodiments disclosed herein, an inner cross-sectional area of a portion through which refrigerant is introduced to a horizontal pipe after passing by the lifting/lowering valve may be provided to be the same as or larger than an inner cross-sectional area of a vertical pipe. Accordingly, a stable flow of refrigerant may be secured.

Further, the suction valve assembly may include a limiting member so as to limit an upward moving distance of the lifting/lowering valve and to accurately block a flow path. The limiting member may be provided in the vertical pipe of the body part, in a refrigerant discharge pipe of the accumulator, or independently of the body part and the accumulator. An outer diameter of the lifting/lowering valve may be larger than an inner diameter of the limiting member and smaller than an inner diameter of the protruding pipe.

Additionally, according to embodiments disclosed herein, the limiting member and the lifting/lowering valve may be configured to be in surface contact with each other. Accordingly, oil may be maximally prevented from leaking to the accumulator.

Also, according to embodiments disclosed herein, the horizontal pipe of the body part may be directly connected to the compression chamber of the compressor and may be indirectly connected to the compression chamber by an additional refrigerant suction pipe. Further, according to embodiments disclosed herein, the vertical pipe of the body part may be directly connected to the accumulator and may be indirectly connected to the accumulator by an additional refrigerant discharge pipe.

As described above, the suction valve assembly of a compressor according to embodiments disclosed herein may be provided in a flow path to guide refrigerant flow between the compressor and the accumulator so as to close the flow path when operation of the compressor stops, whereby oil in the compressor may be prevented from leaking. Lifting and lowering movements of the lifting/lowering valve may be performed by weight and pressure difference between an inner part or space of the compression chamber and an inner part or space of the accumulator, whereby difficulty of maintenance caused by damage to an elastic member, which may be caused by application of the elastic member, such as a coil spring, may be solved.

Further, according to embodiments disclosed herein, the lifting/lowering valve may be lifted and lowered by being guided by the protruding pipe while the lifting/lowering valve is received in the protruding pipe, whereby lifting and lowering movements may be stably performed. Furthermore, according to embodiments disclosed herein, the lifting/lowering valve may protrude from the protruding pipe so as to optimize a height of the lifting/lowering valve exposed to a space positioned between the horizontal pipe and the vertical pipe, whereby loss of an amount of introduced refrigerant may be prevented.

In addition, according to embodiments disclosed herein, the lifting/lowering valve may be configured to be the pipe body having a closed upper surface and to have the one or more communicating holes provided in the circumferential surface of the upper end thereof, whereby the lifting/lowering valve may be efficiently moved upward by pressure of refrigerant reversely flowing. Also, according to embodiments disclosed herein, at least a half portion or half of each of the communicating holes formed in the lifting/lowering valve may be positioned so as to communicate with the inner part of the horizontal pipe. Accordingly, when refrigerant reversely flows due to the pressure difference between the compressor and the accumulator during stopping of operation of the compressor, the pressure of the refrigerant reversely flowing may be efficiently supplied to the lifting/lowering valve, whereby the lifting/lowering valve may efficiently move upward and downward.

Additionally, according to embodiments disclosed herein, a height of the lifting/lowering valve protruding from the protruding pipe or a height of the lifting/lowering valve may be determined such that while the lifting/lowering valve is received in the protruding pipe, a cross-sectional area of a communicating portion between the lifting/lowering valve and the horizontal pipe may be the same as or larger than the cross-sectional area of the lifting/lowering valve in the vertical pipe. Accordingly, loss of the amount of the introduced refrigerant may be prevented.

In addition, according to embodiments disclosed herein, the limiting member may be provided in the vertical pipe of the body part, so an upward moving distance of the lifting/lowering valve is limited. More particularly, the limiting member may have various forms such as a ring-shaped protrusion protruding from an inner circumferential surface of the vertical pipe along the inner circumferential surface, the refrigerant discharge pipe of the accumulator, or an additional member.

Further, according to embodiments disclosed herein, as a contact portion between a lower surface of the ring-shaped limiting member and the upper surface of the lifting/lowering valve may be a plane or a slanted surface such that the lower surface and the upper surface correspond to each other so as to be in surface contact with each other, sealing maintenance may be efficiently performed during contact therebetween and the lifting/lowering valve may stop at an accurate position.

Additionally, according to embodiments disclosed herein, a chamfer may be provided on an edge portion or edge of the upper surface of the lifting/lowering valve, whereby during operation, damage which may occur on the lifting/lowering valve or the limiting member may be minimized.

Further, according to embodiments disclosed herein, as a lower surface of the protruding pipe may be closed, oil may be momentarily stored, and later the momentarily stored oil, together with refrigerant, may be supplied again into the compressor when operation of the compressor restarts, whereby deficiency of oil in the compressor may be prevented. Furthermore, according to embodiments disclosed herein, the lower surface of the protruding pipe may be configured to be open and a closing cover may be provided on the open lower surface of the protruding pipe so as to open and close the open lower surface, whereby when required, the lifting/lowering valve may be replaced with a new one, and thus, maintenance may be easy.

Additionally, the suction valve assembly embodiments disclosed herein may be independent of the refrigerant suction pipe of the compressor and the refrigerant discharge pipe of the accumulator and be connected to each of the refrigerant suction pipe and the refrigerant discharge pipe. Accordingly, manufacturing thereof may be easy.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A suction valve assembly for a compressor, the suction valve assembly comprising:

a body including a horizontal pipe configured to be connected to a compression chamber of the compressor and a vertical pipe configured to be connected vertically to the horizontal pipe, an end of the vertical pipe configured to be connected to an accumulator;

a lifting/lowering valve provided in a connection portion between the horizontal pipe and the vertical pipe, wherein during operation of the compressor, the lifting/lowering valve is moved downward by weight so as to open the connection portion between the horizontal pipe and the vertical pipe and when the operation of the compressor stops, the lifting/lowering valve is moved upward by a pressure difference between an inner space of the accumulator and an inner space of the compression chamber so as to close the connection portion between the horizontal pipe and the vertical pipe; and a protruding pipe provided directly under the vertical pipe of the connection portion between the horizontal pipe and the vertical pipe of the body, an upper surface of the protruding pipe being open, at least a portion of the lifting/lowering valve being positioned in the protruding pipe, wherein the lifting/lowering valve comprises a pipe body, an upper surface of which is closed, at least a portion of a lower surface of which is open, and a circumferential surface of which includes one or more communicating holes provided thereon, each of the communicating holes communicating with an inner space of the horizontal pipe, and wherein the lifting/lowering valve is configured to have a height such that a portion of an upper end thereof protrudes from the protruding pipe during a compression operation, wherein the one or more communicating holes are provided along a circumference of the upper end of the lifting/lowering valve, and wherein during operation of the compressor, at least a portion of each of the communicating holes communicates with the inner space of the horizontal pipe.

2. The suction valve assembly of claim 1, wherein each of the one or more communicating holes is configured to have at least one of a circular shape, an oval shape, or a rounded rectangle shape.

3. The suction valve assembly of claim 1, wherein the one or more communicating holes are provided to be positioned such that at least a half of each of the one or more communicating holes communicates with the inner space of the horizontal pipe.

4. The suction valve assembly of claim 1, wherein an escape groove is concavely formed on an outer circumferential surface of the lifting/lowering valve.

5. The suction valve assembly of claim 1, wherein a limiting member that limits an upward moving distance of the lifting/lowering valve is provided in the vertical pipe of the body.

6. The suction valve assembly of claim 5, wherein the limiting member comprises a ring-shaped protrusion that protrudes from an inner circumferential surface of the vertical pipe or a ring-shaped member.

7. The suction valve assembly of claim 6, wherein an outer diameter of the lifting/lowering valve is larger than an inner diameter of the limiting member and smaller than an inner diameter of the protruding pipe.

8. The suction valve assembly of claim 5, wherein the limiting member is configured to block 5~20% of an entire area of the upper surface of the lifting/lowering valve.

9. The suction valve assembly of claim 5, wherein during an upward movement of the lifting/lowering valve, a lower surface of the limiting member and the upper surface of the lifting/lowering valve are configured to be in surface contact with each other.

10. The suction valve assembly of claim 5, wherein an edge of the upper surface of the lifting/lowering valve is configured to have a chamfer.

11. The suction valve assembly of claim 1, wherein at least a portion of an outer circumferential surface of the lifting/lowering valve and an inner circumferential surface of the protruding pipe are configured to be in surface contact with each other.

12. The suction valve assembly of claim 1, wherein a lower surface of the protruding pipe is closed.

13. The suction valve assembly of claim 1, wherein a lower surface of the protruding pipe is open, and wherein a closing cover is provided to cover the open lower surface of the protruding pipe.

14. The suction valve assembly of claim 1, wherein the horizontal pipe of the body is configured to be connected to a refrigerant suction pipe of the compressor.

15. The suction valve assembly of claim 14, wherein the horizontal pipe is configured to be fitted into and coupled with the refrigerant suction pipe.

16. The suction valve assembly of claim 1, wherein the vertical pipe of the body is configured to be connected to a refrigerant discharge pipe of the accumulator.

17. The suction valve assembly of claim 16, wherein the vertical pipe is configured to be fitted into and coupled with the refrigerant discharge pipe.

18. A compressor comprising the suction valve assembly of claim 1.

19. A compressor, comprising:

a casing;

a refrigerant suction pipe, though which refrigerant is suctioned into the casing;

a compression device including an orbiting scroll and fixed scroll configured to compress the refrigerant in a compression chamber formed therebetween;

an accumulator having a refrigerant discharge pipe in communication with the refrigerant suction pipe; and a suction valve assembly, the suction valve assembly comprising:

a horizontal pipe connected to the compression chamber via the refrigerant suction pipe and a vertical pipe connected vertically to the horizontal pipe, an end of the vertical pipe being connected to the accumulator via the refrigerant discharge pipe;

a valve provided at a connection portion between the horizontal pipe and the vertical pipe, wherein during operation of the compressor, the valve is moved downward by weight so as to open the connection portion between the horizontal pipe and the vertical pipe and when the operation of the compressor stops, the valve is moved upward by a pressure difference between an inner space of the accumulator and an inner space of the compression chamber so as to close the connection portion between the horizontal pipe and the vertical pipe; and a protruding pipe provided under the vertical pipe of the connection portion between the horizontal pipe and the vertical pipe and protruding in a direction opposite to a direction in which the vertical pipe protrudes, an upper surface of the protruding pipe being open, at least a portion of the valve being positioned in the protruding pipe, wherein lifting and lowering movements of the valve are guided by the protruding pipe, wherein the valve comprises a cylindrical body, an upper surface of which is closed, at least a portion of a lower surface of which is open, and a circumferential surface of which includes one or more communicating holes provided thereon, each of the communicating holes communicating with an inner space of the horizontal pipe, and wherein the valve is configured to have a height such that a portion of an upper end thereof protrudes from the protruding pipe during a compression operation, wherein the one or more communicating holes are provided along a circumference of the upper end of the valve, and wherein during operation of the compressor, at least a portion of each of the communicating holes communicates with the inner space of the horizontal pipe.

* * * * *